US010714881B2

(12) United States Patent
Eriksen

(10) Patent No.: US 10,714,881 B2
(45) **Date of Patent: *Jul. 14, 2020**

(54) ANGLED COAXIAL CONNECTORS FOR RECEIVING ELECTRICAL CONDUCTOR PINS HAVING DIFFERENT SIZES

(71) Applicant: PPC Broadband, Inc., East Syracuse, NY (US)

(72) Inventor: Kim Lundgren Eriksen, Tappernøje (DK)

(73) Assignee: PPC BROADBAND, INC., East Syracuse, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/216,704

(22) Filed: Dec. 11, 2018

(65) Prior Publication Data

US 2019/0157821 A1 May 23, 2019

Related U.S. Application Data

(63) Continuation of application No. 15/479,268, filed on Apr. 4, 2017, now Pat. No. 10,153,600.

(Continued)

(51) Int. Cl.
*H01R 9/05* (2006.01)
*H01R 24/54* (2011.01)

(Continued)

(52) U.S. Cl.
CPC ..... *H01R 24/542* (2013.01); *H01R 13/111* (2013.01); *H01R 24/545* (2013.01); *H01R 2103/00* (2013.01)

(58) Field of Classification Search
CPC . H01R 24/542; H01R 24/545; H01R 2103/00
See application file for complete search history.

(56) References Cited

U.S. PATENT DOCUMENTS 2,755,331 A * 7/1956 Melcher ..... H01R 24/545 174/87
2,923,908 A * 2/1960 Cejka ..... H01Q 21/10 439/32

(Continued)

FOREIGN PATENT DOCUMENTS

EP 0 080 845 A1 6/1983

OTHER PUBLICATIONS

Jun. 28, 2017 International Search Report issued in PCT/US17/26024.
Dec. 15, 2017 Office Action issued in U.S. Appl. No. 15/479,268.

*Primary Examiner* — Truc T Nguyen
(74) *Attorney, Agent, or Firm* — MH2 Technology Law Group LLP

(57) ABSTRACT

An electrical connector for receiving a central conductor of a coaxial cable adapter includes first and second body portions, a first electrical contact, and a coupling element. The first body portion is configured to define a first bore extending in a first axial direction, and the second body portion is configured to define a second bore extending in a second axial direction, the second axial direction being angled relative to the first axial direction. The electrical contact is configured to be disposed in the first body portion, and the conductive coupling element in contact with the electrical contact. The second body portion is configured to receive a coaxial cable adapter, and the conductive coupling element is configured to receive a central conductor of the adapter, and the coupling element includes a wall having a first portion with a first inner diameter and a second portion with a second inner diameter, the second inner diameter being smaller that the first inner diameter. The conductive coupling element includes a plurality of spring fingers that, in a rest position, extend radially inward from the first portion of the coupling element to define an opening having (Continued)

a diameter that is smaller than the second inner diameter such that the coupling element is configured to receive the central conductor having a diameter equal to or less than the second diameter and provide an electrical connection between the electrical contact and the central conductor.

20 Claims, 9 Drawing Sheets

Related U.S. Application Data

(60) Provisional application No. 62/318,207, filed on Apr. 4, 2016.

(51) Int. Cl.
*H01R 13/11* (2006.01)
*H01R 103/00* (2006.01)

(56) References Cited

U.S. PATENT DOCUMENTS 4,655,534 A 4/1987 Stursa
4,857,014 A 8/1989 Alf et al.
4,881,912 A 11/1989 Thommen et al.
5,122,063 A 6/1992 Cooper
5,971,770 A 10/1999 Richmond
6,106,333 A 8/2000 Purdy
6,679,728 B1 1/2004 Huang et al.
9,515,430 B2 * 12/2016 Saller ..... H01R 4/10
9,716,345 B2 7/2017 Watkins
10,348,003 B2 * 7/2019 Singhammer ..... H01R 13/514
2004/0137790 A1 * 7/2004 Lee ..... H01R 4/28 439/582
2009/0017678 A1 1/2009 Meier et al.
2010/0029149 A1 2/2010 Malloy et al.
2010/0146784 A1 6/2010 Johnsen
2011/0021075 A1 * 1/2011 Orner ..... H01R 9/0518 439/585
2012/0088404 A1 4/2012 Wild et al.
2013/0012062 A1 1/2013 Nugent
2013/0157505 A1 6/2013 Sykes et al.
2013/0203288 A1 8/2013 Hosler, Sr.
2016/0336676 A1 11/2016 Stevens et al.

* cited by examiner

ANGLED COAXIAL CONNECTORS FOR RECEIVING ELECTRICAL CONDUCTOR PINS HAVING DIFFERENT SIZES

CROSS-REFERENCE TO RELATED APPLICATIONS

This is a continuation of U.S. patent application Ser. No. 15/479,268, filed Apr. 4, 2017, pending, which claims the benefit of U.S. Provisional Application No. 62/318,207, filed Apr. 4, 2016. The disclosure of the prior applications is hereby incorporated by reference herein in its entirety.

TECHNICAL FIELD

The present disclosure relates generally to the field of coaxial cable connectors and, more particularly, to angled coaxial connectors configured to receive coaxial cable adapters including electrical conductor pins having different sizes.

BACKGROUND

Coaxial cable assemblies are commonly used for transmitting electrical signals over a length of coaxial cable. Coaxial cable typically includes a center conductor and an outer conductor that are electrically isolated from one another by a dielectric. The outer conductor is grounded so that it operates as an electrical shield around the center conductor to prevent a degradation of the signal carried by the central conductor. A coaxial cable assembly includes a pair of coaxial connectors each having an outer conductive shell that is coupled electrically, typically by crimping a ferrule, with one end of the outer conductor of the coaxial cable. The center conductor at each end of the coaxial cable is connected to a central pin or contact of the corresponding one of the coaxial connectors. The central contact is electrically isolated from the outer housing by a dielectric.

Under certain circumstances in which a straight-line or linear connection is impractical or impossible, a right angle coaxial connector is used for making an angled connection. Usually, the central conductor of the coaxial cable is connected perpendicularly with the central contact of the right angle coaxial connector within an interior chamber provided proximate to the right-angle bend in the coaxial connector. The connection is established by soldering the center conductor and the center contact together after the coaxial cable is inserted through a cable opening in the connector housing so that the central conductor is positioned in the interior chamber. Access to the interior chamber from the exterior of the connector is afforded through an access opening, which is sealed by a removable closure. With the closure removed, a tip of a soldering iron is inserted through the access opening to create the solder joint. Subsequently, the removable closure is replaced over the access opening to seal the interior chamber against signal leakage and to prevent inward penetration of contaminants from the environment surrounding the right angle coaxial connector.

Conventional right angle coaxial connectors suffer from several deficiencies and shortcomings. For example, some conventional right angle coaxial connectors are difficult to assemble due to the soldering operation and the concomitant need to provide an interior chamber accessible through an access opening covered by a removable closure.

Other conventional right angle coaxial connectors can only receive coaxial cable adapters having central conductive pins of a particular outside diameter. In order to accommodate the needs of various users, an installer would need to maintain an inventory of numerous different conventional connectors that can receive the different-sized central conductive pins.

Accordingly, there is a need to overcome, or otherwise lessen the effects of, the disadvantages and shortcomings described above. Hence, a need exists for an improved angled connector that can accommodate coaxial cable adapters having central conductive pins of varying outside diameters.

SUMMARY

According to various aspects of the disclosure, an electrical connector for receiving a central conductor of a coaxial cable adapter includes a first body portion, a second body portion, a first electrical contact, and a coupling element. The first body portion has a first tubular portion disposed about a first axis and defining a first bore. The second body portion has a second tubular portion disposed about a second axis and defining a second bore. The second axis intersects the first axis, and the second bore being configured to receive a coaxial cable adapter. The first electrical contact is secured within the first bore and has a first end within the first body portion and a second end outside of the first bore. The first end of the first electrical contact has an opening in a side wall thereof. The coupling element is configured to securely receive a central conductor of the adapter and to have a first diameter defined by a plurality of spring members in a rest position and a second diameter, greater than the first diameter, defined by an inner surface of a tubular wall of the coupling element when the spring members are urged outwardly.

In some embodiments of the connector, the first tubular portion and the second tubular portion are electrically conductive. According to some aspects, a first insulator may separate the first electrical contact from the first tubular portion and/or a second insulator may separate the coupling element from the first tubular portion and the second tubular portion.

According to various aspects, the first axis intersects the second axis at a right angle. In some aspects, the adapter is an amplifier or a splitter.

In some aspects of the disclosure, an outside diameter of the central conductor can range from the first diameter defined by the spring members in a rest position to the second diameter defined by the inner surface of the tubular wall of the coupling element.

According to some embodiments, the coupling element is disposed in the opening in the side wall of the first electrical contact and extends in a direction of the second axis, and the plurality of spring members extend inward from the tubular wall.

In various aspects, the connector may further comprise an insulator configured to guide the central conductive pin into the coupling element. In some aspects, the central conductive pin may be configured to limit a length of the central conductive pin that extends into the coupling element.

In accordance with various aspects of the disclosure, an electrical connector for receiving a central conductor of a coaxial cable adapter includes a first housing portion, a second housing portion, a first electrical contact, and a coupling element. The first housing portion is disposed about a first longitudinal axis and defines a first bore. The second housing portion has a second tubular portion and defines a second bore. The second housing portion is disposed about a second longitudinal axis that intersects the first longitudinal axis, and the second bore is configured to receive a coaxial cable adapter. The first electrical contact is secured within the first bore, extends from the first housing portion, and has a first end within the first housing portion and a second end outside of the first bore. The first end of the first electrical contact has an opening in a side wall thereof. The coupling element is disposed in the opening in the side wall of the first electrical contact and extending in a direction of the second axis. The coupling element has a tubular wall and includes a plurality of spring members extending inward from the tubular wall such that the coupling element is configured to securely receive a central conductor of the adapter. The coupling element is configured to have a first diameter defined by the spring members in a rest position and a second diameter, greater than the first diameter, defined by an inner surface of the tubular wall of the coupling element when the spring members are urged outwardly by the central conductor of the adapter.

In some aspects, an outside diameter of the central conductor can range from a first diameter defined by the spring members in a rest position to a second diameter defined by an inner surface of the tubular wall of the coupling element.

According to some aspects, the first tubular portion and the second tubular portion are electrically conductive. In some embodiments, a first insulator is configured to electrically insulate the first electrical contact from the first tubular portion and/or a second insulator is configured to electrically insulate the coupling element from the first tubular portion and the second tubular portion.

In some embodiments, the first axis intersects the second axis at a right angle. In various embodiments, the adapter is an amplifier or a splitter.

According to some aspects, the connector may further include an insulator configured to guide the central conductive pin into the coupling element. In some embodiments, the central conductive pin is configured to limit a length of the central conductive pin that extends into the coupling element. In some embodiments, the central conductive pin has a tapered region complementary to a tapered opening in the insulator such that the cooperation between the tapered opening and the tapered region limit the length of the central conductive pin that extends into the coupling element.

BRIEF DESCRIPTION OF THE DRAWINGS

Features and advantages of the present disclosure are described in, and will be apparent from, the following Brief Description of the Drawings and Detailed Description.

DETAILED DESCRIPTION

Figure 1:
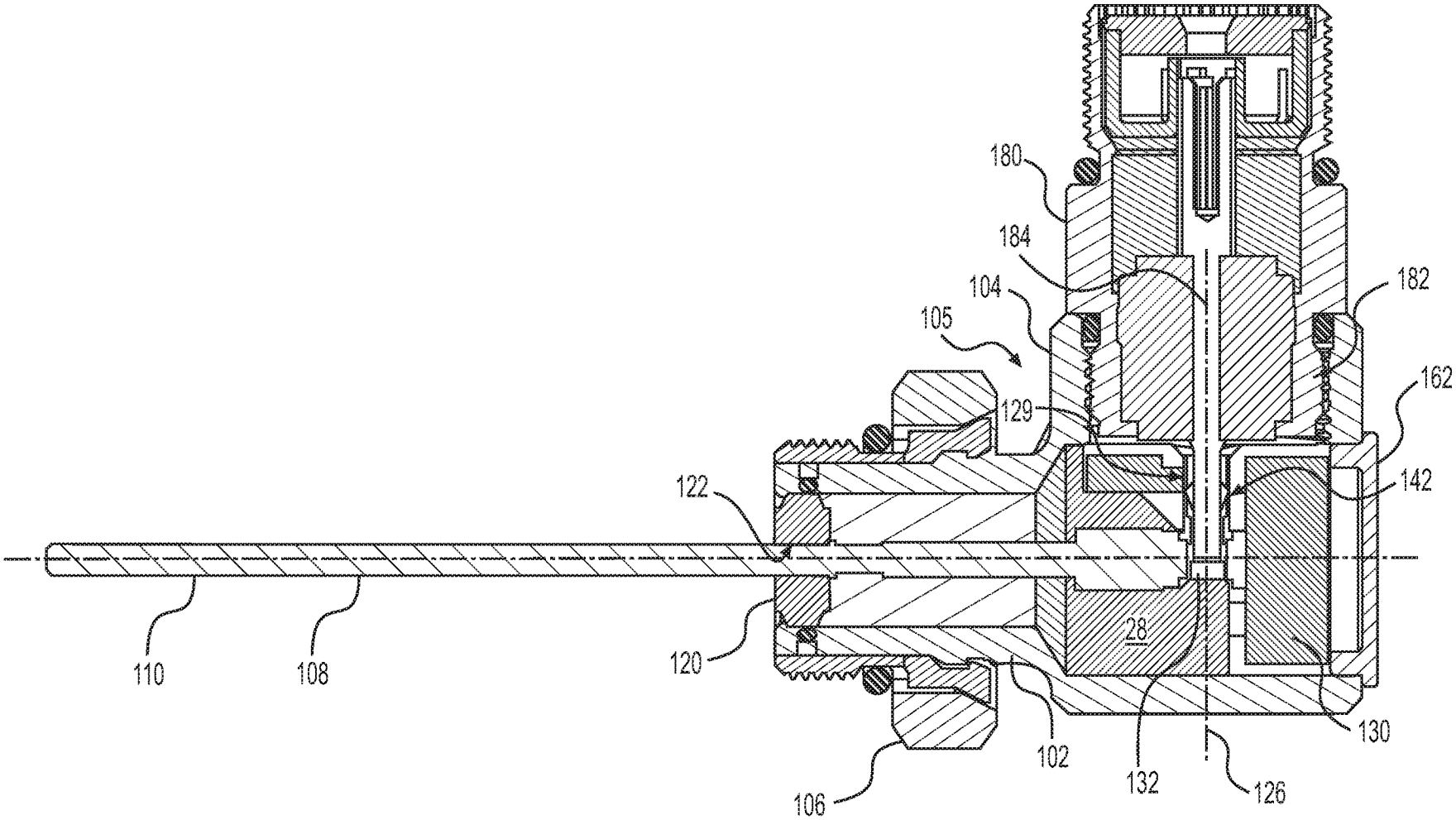
FIG. 1 is a cross-sectional side view of an exemplary right angle coaxial connector in accordance with various aspects of the disclosure coupled with an exemplary coaxial cable adapter.

Referring to FIGS. 1-5, an exemplary right angle coaxial connector 100 according to various aspects of the disclosure includes a first conductive outer housing section 102 and a second conductive outer housing section 104 that together define an outer housing 105. It should be appreciated that the first and second conductive outer housing sections 102, 104 may be integrally formed of a single piece having a monolithic construction. In some aspects, the first and second conductive outer housing sections 102, 104 may be separately formed and integrally connected. The connector 100 may include a conductive coupling nut 106 mounted to the first conductive outer housing section 102, a central conductive pin 108 extending along a longitudinal axis 110 of the first conductive outer housing section 102, and an annular dielectric insulator 120 electrically insulating the central conductive pin 108 from first conductive outer housing section 102. The insulator 120 has a central bore 122 configured to mechanically support and align the central conductive pin 108 along the longitudinal axis 110.

The second conductive outer housing section 104 defines a cylindrical passageway 124 having a longitudinal axis 126 aligned generally at a right angle relative to the longitudinal axis 110. It is should be appreciated that the longitudinal axis 110 and the longitudinal axis 124 may be oriented relative to one another in an angular relationship that is non-perpendicular, including but not limited to 45° and 135°. The cylindrical passageway 124 may be configured to receive a portion of a coaxial cable adapter 180, for example, an interface post 182. The cylindrical passageway 124 communicates with a chamber 128 located inside the outer housing 105 by a passage 129. An insulator 130 may be disposed in the chamber 128 and provides the passage 129 from the cylindrical passageway 124 to the chamber 128.

The insulator 130 provides a seal that protects the integrity of the electrical connection between a blunted, generally-conical back end 132 of the central conductive pin 108 and a receptacle of a complementary female electrical connector (not shown) with which the first conductive outer housing section 102 of the right angle coaxial connector 100 is coupled. The coupling nut 106 is configured to secure the right angle coaxial connector 100 mechanically with the complementary female electrical connector to prevent separation after the electrical connection is established.

Figure 2:
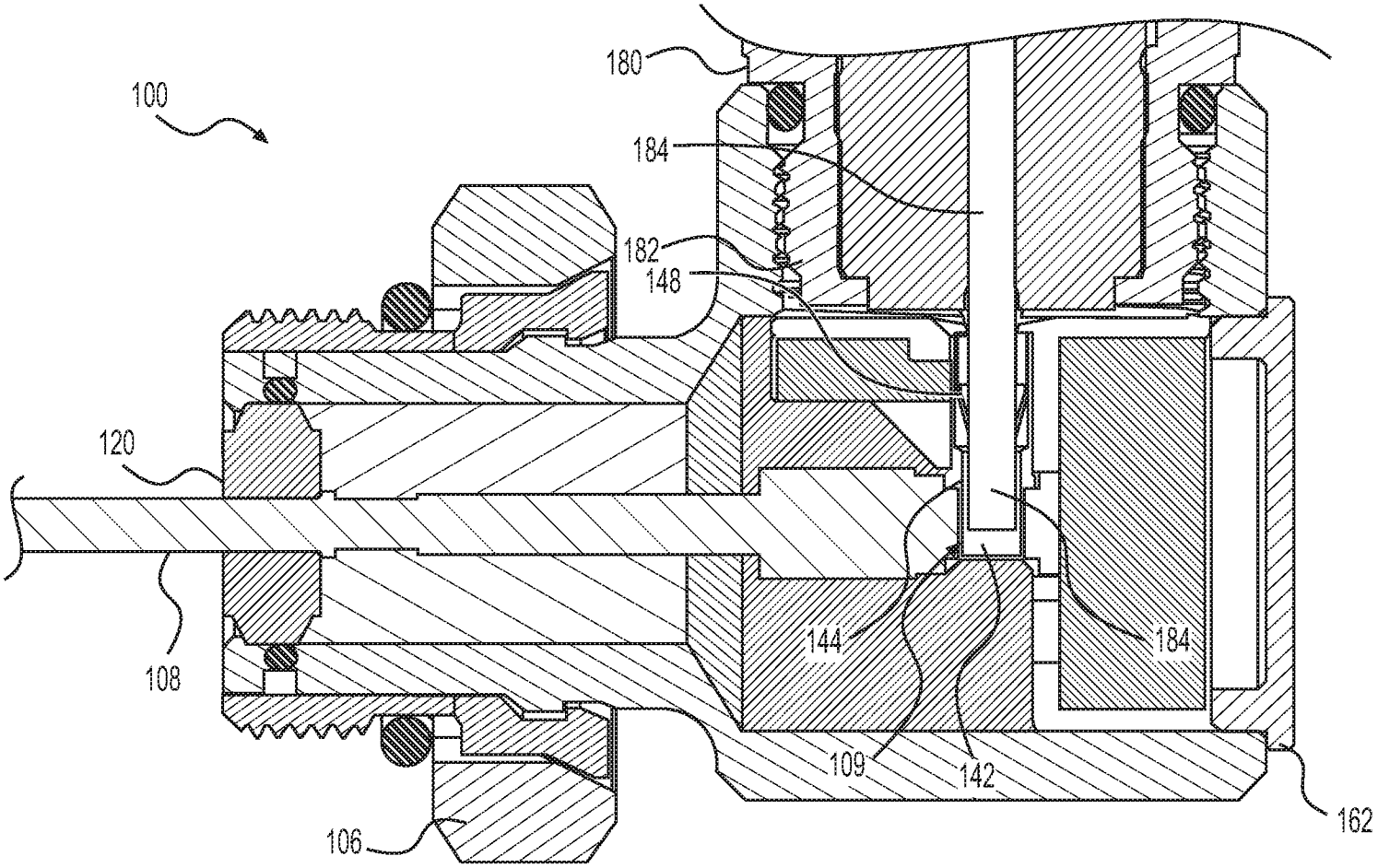
FIG. 2 is an enlarged cross-sectional side view of the exemplary right angle coaxial connector and exemplary coaxial cable adapter of FIG. 1.
Figure 3:
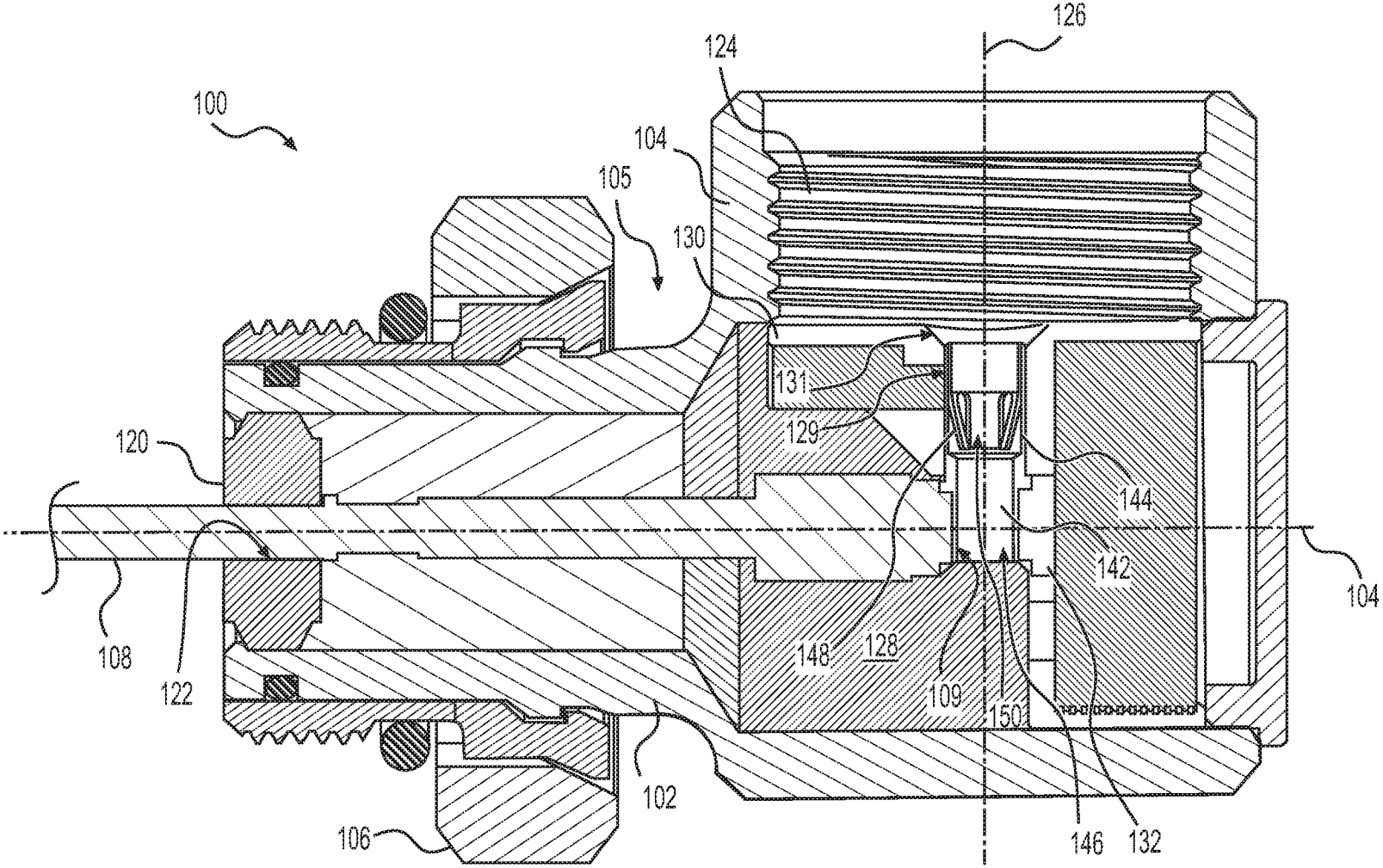
FIG. 3 is a cross-sectional side view of the exemplary right angle coaxial connector of FIG. 1.
Figure 4:
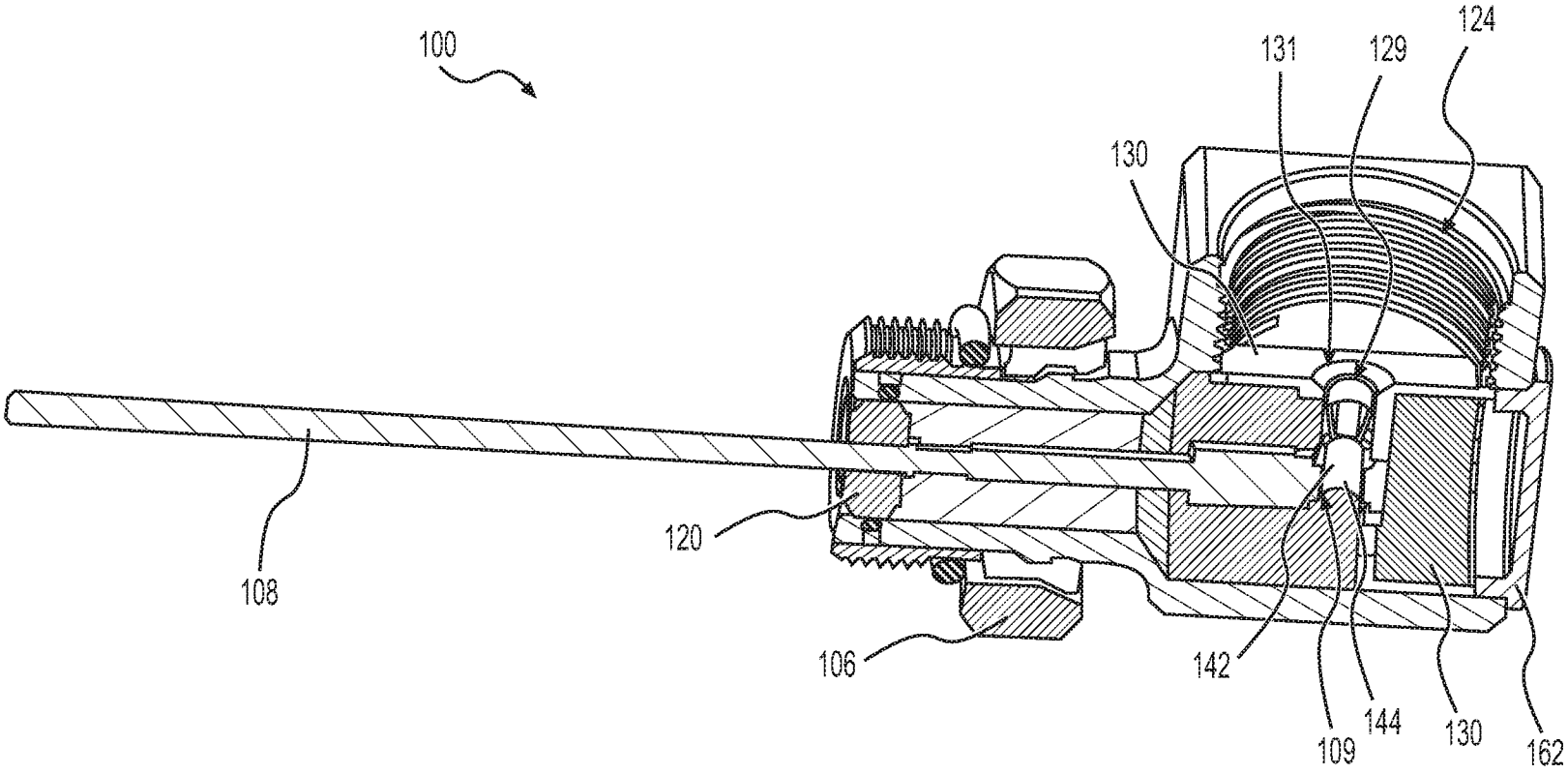
FIG. 4 is a cross-sectional perspective view of the exemplary right angle coaxial connector of FIG. 1.
Figure 5:
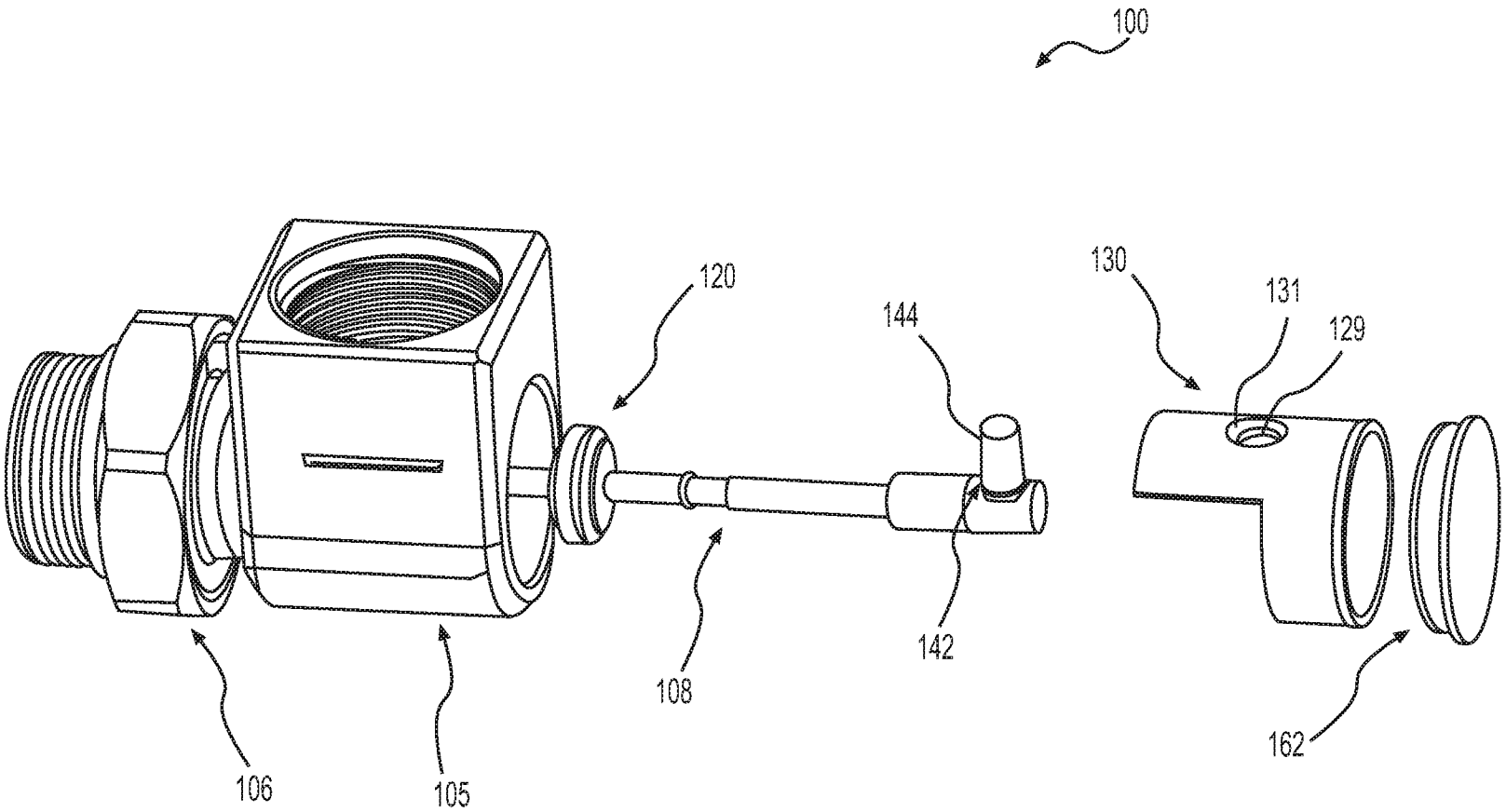
FIG. 5 is an exploded view of the exemplary right angle coaxial connector of FIG. 1.
Figure 8:
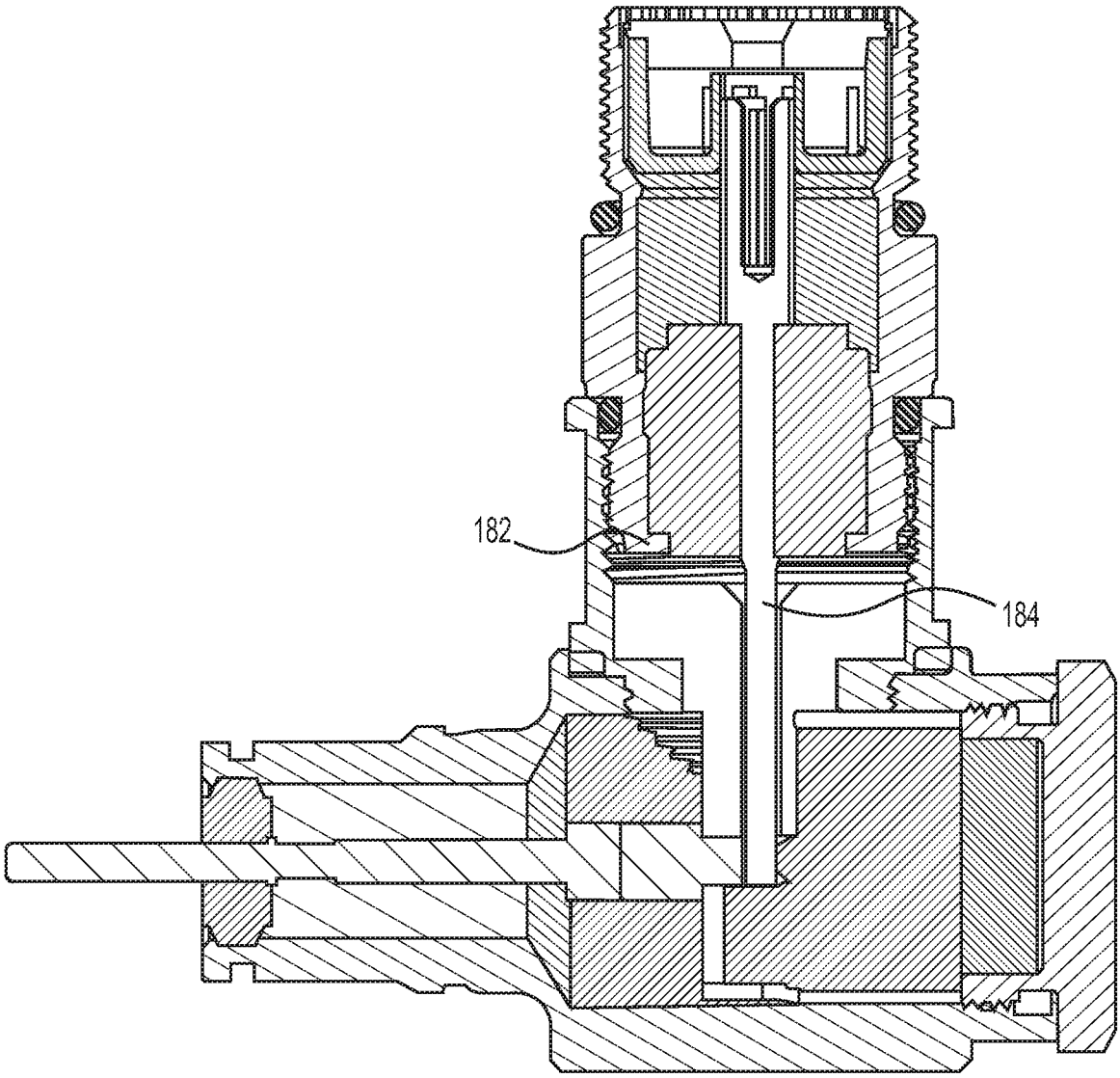
FIG. 8 is a cross-sectional side view of a conventional right angle coaxial connector coupled with an exemplary coaxial cable adapter.

As shown in FIGS. 1 and 2, the right angle coaxial connector 100 may be assembled with the coaxial cable adapter 180 that includes a central conductive pin 184, the conductive interface post 182 surrounding the central pin 184, and a dielectric insulator 186 electrically isolating the central conductive pin 184 from the conductive interface post 182. For example, the dielectric insulator 186 may be disposed about the central conductive pin 184 and between the central conductive pin 184 and the conductive interface post 182, as shown in FIGS. 1, 2, and 8. A length of the central pin 184 extends from an end of the interface post 182 of the adapter 180 and is configured to establish an electrical connection with the central pin 108. The coaxial adapter 180 may be a conventional coaxial cable adapter, for example, an adapter having a first end with a male interface post 182 and male central conductive pin 184. The second end of the coaxial adapter 180 may have a male interface post and female central conductive connector configured to receive a male central conductor.

The connector 100 includes a coupling element 142 configured to facilitate the electrical connection between the central conductive pin 108 and the central conductive pin 184. The coupling element 142 is received in an opening 109 in a wall of the central conductive pin 108. The coupling element 142 is connected with the central conductive pin 108 in a manner so as to provide an electrical connection between the central conductive pin 184 and the central conductive pin 108. The coupling element 142 is configured to receive central pins of varying sizes, thus obviating the conventional requirement of having a different right angle connector for each size of central conductive pin 184 of various adapters. The insulator 130 may include a tapered opening 131 configured to guide the central conductive pin 184 through the passage 129 and into the coupling element 142. The coupling element 142 may be formed of a metal or a suitable electrically-conductive alloy. As identified by the circled region of the central conductive pin 184 in FIG. 2, the central conductive pin 184 may have a region having a larger diameter than a remainder of the central conductive pin 184. The larger diameter region may be tapered in a manner complementary to the tapered opening 131 such that the cooperation between the tapered opening 131 and the tapered larger diameter region of the central conductive pin 184 may limit the length of the central conductive pin 184 that can extend into the coupling element 142.

According to various aspects of the disclosure, the coupling element 142 includes a body member 144 having a cylindrical bore 146 extending therethrough. One end of the body member 144 includes a plurality of, for example, four, spring arms 148 projecting inwardly toward a center of the bore 146. At a rest (i.e., unstressed) position, the inner surfaces of the spring arms 148 define a passageway 150 having a smaller cross-sectional area than the cylindrical bore. The spring arms 148 are resiliently attached to the body member 144 so that an outwardly directed force of a sufficient magnitude causes the spring arms 148 to move outwardly toward the body member 144. Thus, the spring arms 148 can be structured and arranged such that the passageway 150 is slightly smaller than an outside diameter of the smallest central conductive pin 184 desired to be used with the connector 100, while the cylindrical bore 146 is slightly larger than an outside diameter of the largest central conductive pin 184 desired to be used with the connector 100. The coupling element 142 thus enables the connector 100 to be used with various adapters 180 having central conductive pins 184 of varying sizes.

The connector 100 includes an access opening 160 providing access to an interior of the housing 105 from the exterior of the connector 100. The access opening 160 is sealed by a removable closure 162. The removable closure 162 may be a plug, for example, a metal plug. In some aspects, the metal plug 162 may be brass. The closure 162 can be removed to facilitate assembly of the conductive pin 108, insulator 120, coupling element 142, and insulator 130 within the chamber 128.

It should be appreciated that the conductive elements of the connector 100 including, but not limited to, the housing 105, the coupling nut 106, the central conductive pin 108, and the coupling element, may be constructed of a metal, such as for example, brass, or suitable electrically-conductive alloy. The insulative elements of the connector 100 including, but not limited to, the insulators 120, 130, may be constructed of a plastic or any other dielectric material.

Figure 6A:
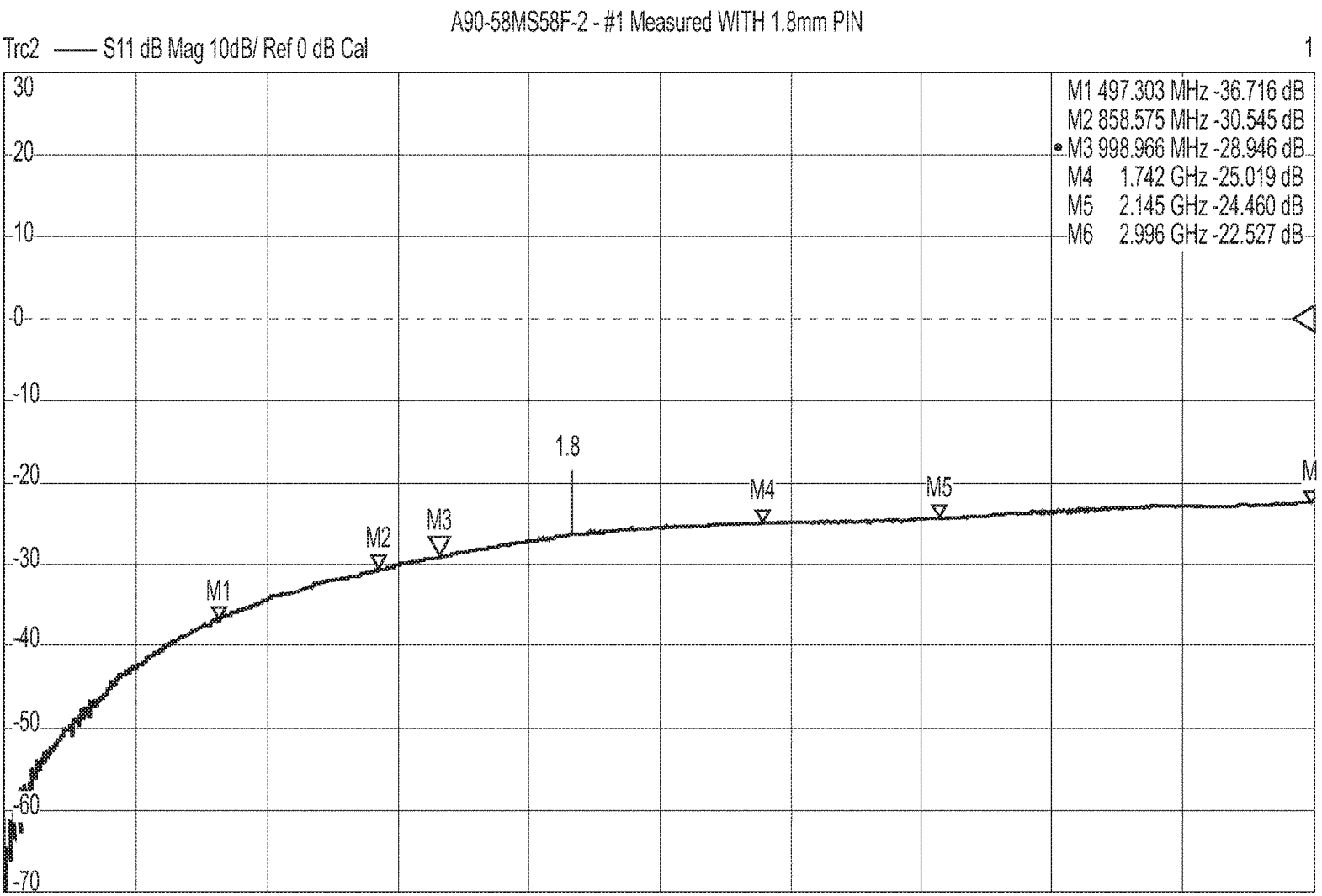
FIG. 6A is a graph of the RF signal of a conventional angle connector configured to receive a 1.8 mm central conductive pin.
Figure 6B:
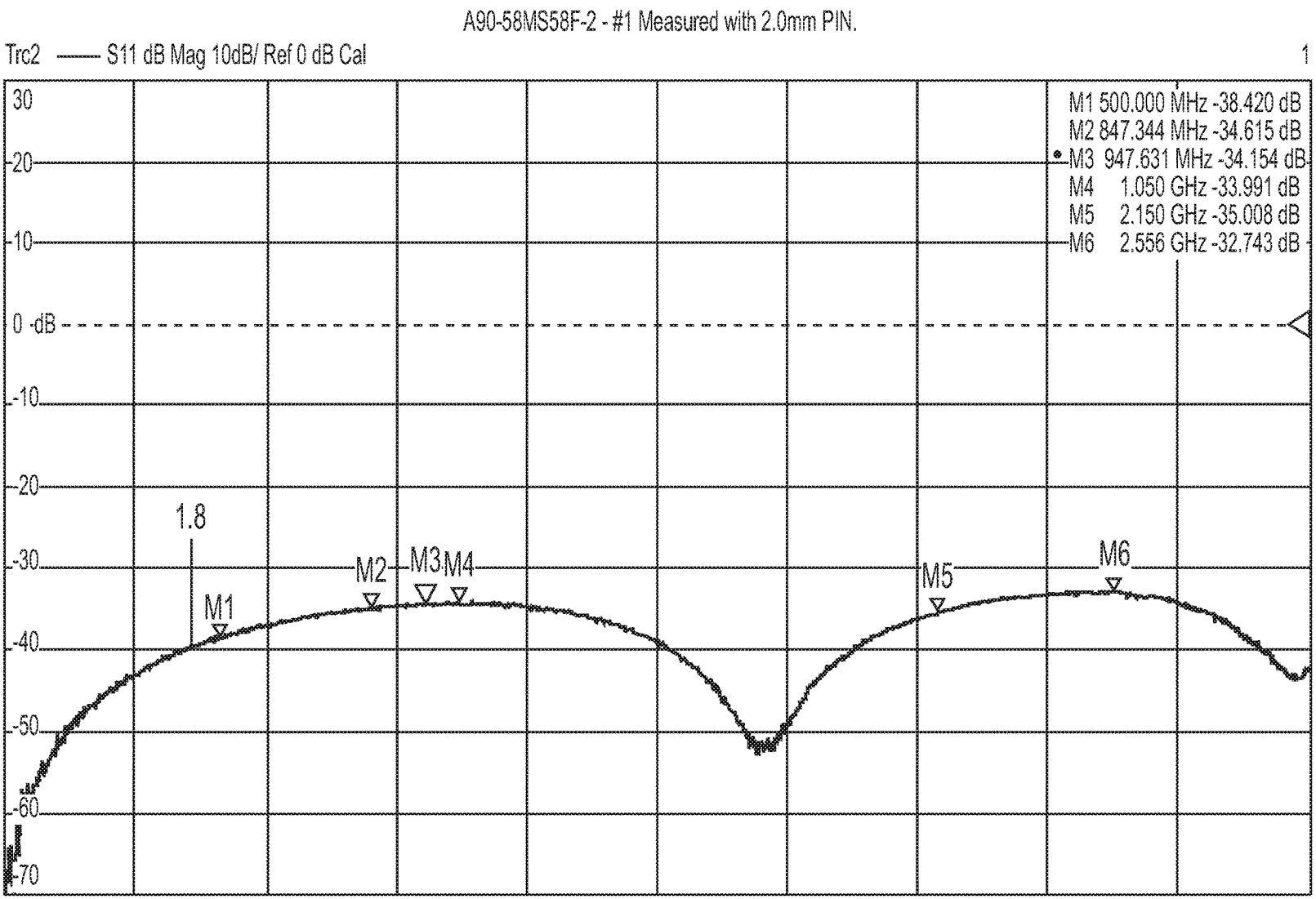
FIG. 6B is a graph of the RF signal of a conventional angle connector configured to receive a 2.0 mm central conductive pin.
Figure 7:
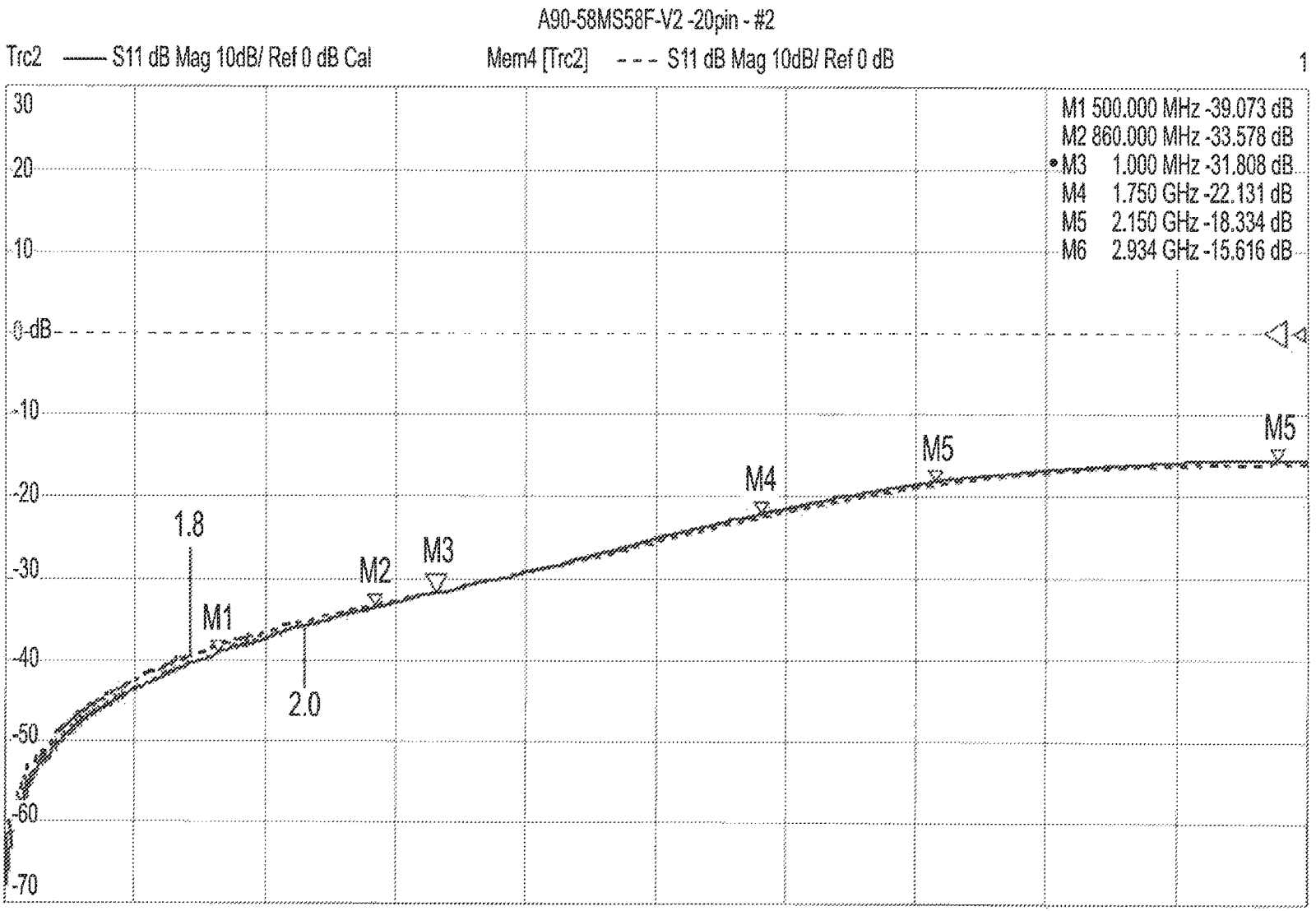
FIG. 7 is a graph of the RF signal of the right angle connector of FIG. 1 when receiving a 1.8 mm and a 2.0 mm central conductive pin.

FIGS. 6A and 6B illustrate the inconsistent RF signals associated with a conventional right angle connector used with coaxial cable adapters having central conductive pins with 1.8 mm and 2.0 mm outside diameters, respectively. FIG. 7 illustrates the consistent RF signals associated with the right angle connector 100 according to the disclosure, when used with coaxial cable adapters having central conductive pins with 1.8 mm and 2.0 mm outside diameters.

Referring to FIG. 8, the circled portion of the central conductive pin 184 illustrates the length of the pin 184 that extended from the interface post 182 in a conventional right angle connector. The length of the pin 184 extending from the interface post 182 and exposed to an insulator had a negative effect on the RF signal quality. Referring back to FIG. 1, the length of the pin 184 that extends from the interface post 182 in the connector 100 according to the disclosure has been shortened, thereby having a positive effect on the RF signal quality.

Additional embodiments include any one of the embodiments described above, where one or more of its components, functionalities or structures is interchanged with, replaced by or augmented by one or more of the components, functionalities or structures of a different embodiment described above.

It should be understood that various changes and modifications to the embodiments described herein will be apparent to those skilled in the art. Such changes and modifications can be made without departing from the spirit and scope of the present disclosure and without diminishing its intended advantages. It is therefore intended that such changes and modifications be covered by the appended claims.

Although several embodiments of the disclosure have been disclosed in the foregoing specification, it is understood by those skilled in the art that many modifications and other embodiments of the disclosure will come to mind to which the disclosure pertains, having the benefit of the teaching presented in the foregoing description and associated drawings. It is thus understood that the disclosure is not limited to the specific embodiments disclosed herein above, and that many modifications and other embodiments are intended to be included within the scope of the appended claims. Moreover, although specific terms are employed herein, as well as in the claims which follow, they are used only in a generic and descriptive sense, and not for the purposes of limiting the present disclosure, nor the claims which follow.

What is claimed is:

1. An electrical connector comprising:

a first body portion having a first longitudinal axis extending in a first axial direction;

a second body portion having a second longitudinal axis extending in a second axial direction, the second axial direction being angled relative to the first axial direction;

an electrical contact configured to be disposed in the first body portion; and a conductive coupling element in contact with the electrical contact, wherein the second body portion is configured to receive a coaxial cable adapter, and the conductive coupling element is configured to receive a central conductor of the adapter, wherein the coupling element includes a wall having a first portion with a first inner diameter and a second portion with a second inner diameter, the second inner diameter being smaller that the first inner diameter, and wherein the conductive coupling element includes a plurality of flexible fingers that, in a rest position, extend radially inward from the first portion of the coupling element to define an opening having a diameter that is smaller than the second inner diameter such that the coupling element is configured to receive the central conductor having a diameter equal to or less than the second inner diameter and provide an electrical connection between the electrical contact and the central conductor.

2. The connector of claim 1, wherein the first body portion and the second body portion are electrically conductive.

3. The connector of claim 2, further comprising an insulator separating the electrical contact from the first body portion.

4. The connector of claim 3, further comprising a second insulator separating the coupling element from the first body portion and the second body portion.

5. The connector of claim 1, wherein the first axial direction is perpendicular to the second axial direction.

6. The connector of claim 1, wherein the coaxial cable adapter is an amplifier or a splitter.

7. The connector of claim 1, wherein an outside diameter of the central conductor can range from the diameter of the opening defined by the flexible fingers in the rest position to the second inner diameter of the second portion of the wall of the coupling element.

8. The connector of claim 1, wherein the coupling element is disposed in an opening in a side wall of the electrical contact and extends in the second axial direction.

9. The connector of claim 1, further comprising an insulator configured to guide the central conductor into the coupling element.

10. The connector of claim 9, wherein the central conductor is configured to limit a length of the central conductor that extends into the coupling element.

11. An electrical connector comprising:

a first body portion having a first longitudinal axis extending in a first axial direction;

a second body portion having a second longitudinal axis extending in a second axial direction, the second axial direction being angled relative to the first axial direction;

an electrical contact configured to be disposed in the first body portion; and a conductive coupling element in contact with the electrical contact, wherein the second body portion is configured to receive a coaxial cable adapter, and the conductive coupling element is configured to receive a central conductor of the adapter, wherein the coupling element includes a wall having a first portion with a first inner diameter and a second portion with a second inner diameter, the second inner diameter being smaller that the first inner diameter, and wherein the conductive coupling element is configured to define, in a rest position, an opening having a diameter that is smaller than the second inner diameter such that the coupling element is configured to receive the central conductor having a diameter equal to or less than the second inner diameter and provide an electrical connection between the electrical contact and the central conductor.

12. The connector of claim 11, wherein the first body portion and the second body portion are electrically conductive.

13. The connector of claim 12, further comprising an insulator separating the electrical contact from the first body portion.

14. The connector of claim 13, further comprising a second insulator separating the coupling element from the first body portion and the second body portion.

15. The connector of claim 11, wherein the first axial direction is perpendicular to the second axial direction.

16. The connector of claim 11, wherein the coaxial cable adapter is an amplifier or a splitter.

17. The connector of claim 11, wherein an outside diameter of the central conductor can range from the diameter of the opening defined by the conductive coupling element in the rest position to the second inner diameter of the second portion of the wall of the coupling element.

18. The connector of claim 11, wherein the coupling element is disposed in an opening in a side wall of the electrical contact and extends in the second axial direction.

19. The connector of claim 11, further comprising an insulator configured to guide the central conductor into the coupling element.

20. The connector of claim 19, wherein the central conductor is configured to limit a length of the central conductor that extends into the coupling element.

* * * * *